US005127416A

United States Patent [19]

Wakabayashi et al.

[11] Patent Number: 5,127,416

[45] Date of Patent: Jul. 7, 1992

[54] APPARATUS FOR CLEANING INTERIOR OF ASEPTIC CHAMBER OF PACKAGING MACHINE

[75] Inventors: Shigeru Wakabayashi; Masao Shimokawa, both of Tokushima, Japan

[73] Assignee: Shikoku Kakoki Co., Ltd., Tokushima, Japan

[21] Appl. No.: 610,643

[22] Filed: Nov. 8, 1990

[30] Foreign Application Priority Data

Nov. 9, 1989 [JP] Japan ..... 1-130848[U]

[51] Int. Cl.[5] ..... B08B 3/02

[52] U.S. Cl. ..... 134/104.1; 134/172; 134/181; 134/167 R; 134/115 R; 53/167

[58] Field of Search ..... 198/495; 134/153, 151, 134/172, 181, 200, 104.1, 115, 166 R, 167 R; 366/138; 53/167, 426, 425

[56] References Cited

U.S. PATENT DOCUMENTS

| | | | |
|---|---|---|---|
| 2,386,455 | 10/1945 | Green | 134/167 X |
| 2,525,348 | 10/1950 | Glass | 198/495 |
| 3,017,986 | 1/1962 | Ackles | 198/495 |
| 3,101,730 | 8/1963 | Harris et al. | 134/167 R |
| 3,783,581 | 1/1974 | Pierce | 53/426 |
| 3,981,315 | 9/1976 | Olthoff | 134/167 R |
| 4,073,376 | 2/1978 | Kroos | 15/101 X |
| 4,226,325 | 10/1980 | Vandas | 134/95 X |
| 4,375,145 | 3/1983 | Mosse et al. | 53/425 |
| 4,770,196 | 9/1988 | Osswald | 134/166 R |
| 4,830,175 | 5/1989 | Durst et al. | 198/495 |
| 4,860,883 | 8/1989 | Knaul et al. | 198/495 |
| 4,960,200 | 10/1990 | Pierce | 198/495 |

FOREIGN PATENT DOCUMENTS

| | | | |
|---|---|---|---|
| 1207932 | 1/1986 | U.S.S.R. | 198/495 |

*Primary Examiner*—Frankie L. Stinson
*Attorney, Agent, or Firm*—Armstrong, Nikaido, Marmelstein, Kubovcik & Murray

[57] ABSTRACT

An apparatus for cleaning the interior of an aseptic chamber having enclosed therein a container transport conveyor of a packaging machine and separating off a required packaging work space from the outside air. The apparatus comprises at least one rotatable spray pipe disposed inside the aseptic chamber and extending approximately over the entire length of the path of transport of containers in parallel thereto, and means for supplying a pressurized cleaning solution to the interior of the spray pipe. The spray pipe has a multiplicity of spray orifices arranged at a predetermined spacing approximately over the entire length thereof.

7 Claims, 6 Drawing Sheets

APPARATUS FOR CLEANING INTERIOR OF ASEPTIC CHAMBER OF PACKAGING MACHINE

BACKGROUND OF THE INVENTION

The present invention relates to an apparatus for cleaning the interior of an aseptic chamber having enclosed therein a container transport conveyor of a packaging machine for separating off a required packaging work space from the outside air.

Such an apparatus is already known which comprises spray balls arranged at required portions inside an aseptic chamber.

Although it is desired that the apparatus have a larger number of spray balls as arranged within the aseptic chamber, the number is limited in view of the space available. The chamber can be cleaned fully at the locations close to the sprays balls but can not be cleaned effectively at locations remote from the balls. It is especially difficult to clean the corners of the chamber.

SUMMARY OF THE INVENTION

The main object of the present invention is to overcome the above problem and to provide an apparatus capable of completly cleaning the entire interior of a chamber.

The present invention provides an apparatus for cleaning the interior of an aseptic chamber which comprises at least one rotatable spray pipe disposed inside the aseptic chamber and extending approximately over the entire length of a path of transport of containers in parallel thereto, the spray pipe having a multiplicity of spray orifices arranged at a predetermined spacing approximately over the entire length thereof, and means for supplying a pressurized cleaning solution to the interior of the spray pipe.

When the pressurized cleaning solution is supplied to the spray pipe while rotating the spray pipe, the solution can be sprayed from the orifices over the entire length and the entire circumference of the pipe, so that the interior of the chamber can be completely cleaned.

DESCRIPTION OF THE PREFERRED EMBODIMENT

An embodiment of the present invention will be described below with reference to the drawings.

Packaging machines have an aseptic chamber 12 having enclosed therein a container transport conveyor 11 and separating off a required packaging work space from the outside air. The aseptic chamber 12 is in the form of a hollow rectangular parallelepiped elongated in the front-to-rear direction and square to rectangular in cross section and has a top wall 12*a*, front wall 12*b* and rear wall 12*c*.

Although not shown, the top wall 12*a* of the chamber 12 is provided with a series of devices arranged in succession from rear to front for supplying containers to the conveyor 11, filling a flowable food or like product into the containers while the containers are being transported by the conveyor 11, thereafter hermetically closing the top of each container, and finally discharging the filled containers from the chamber 12.

Figure 1:
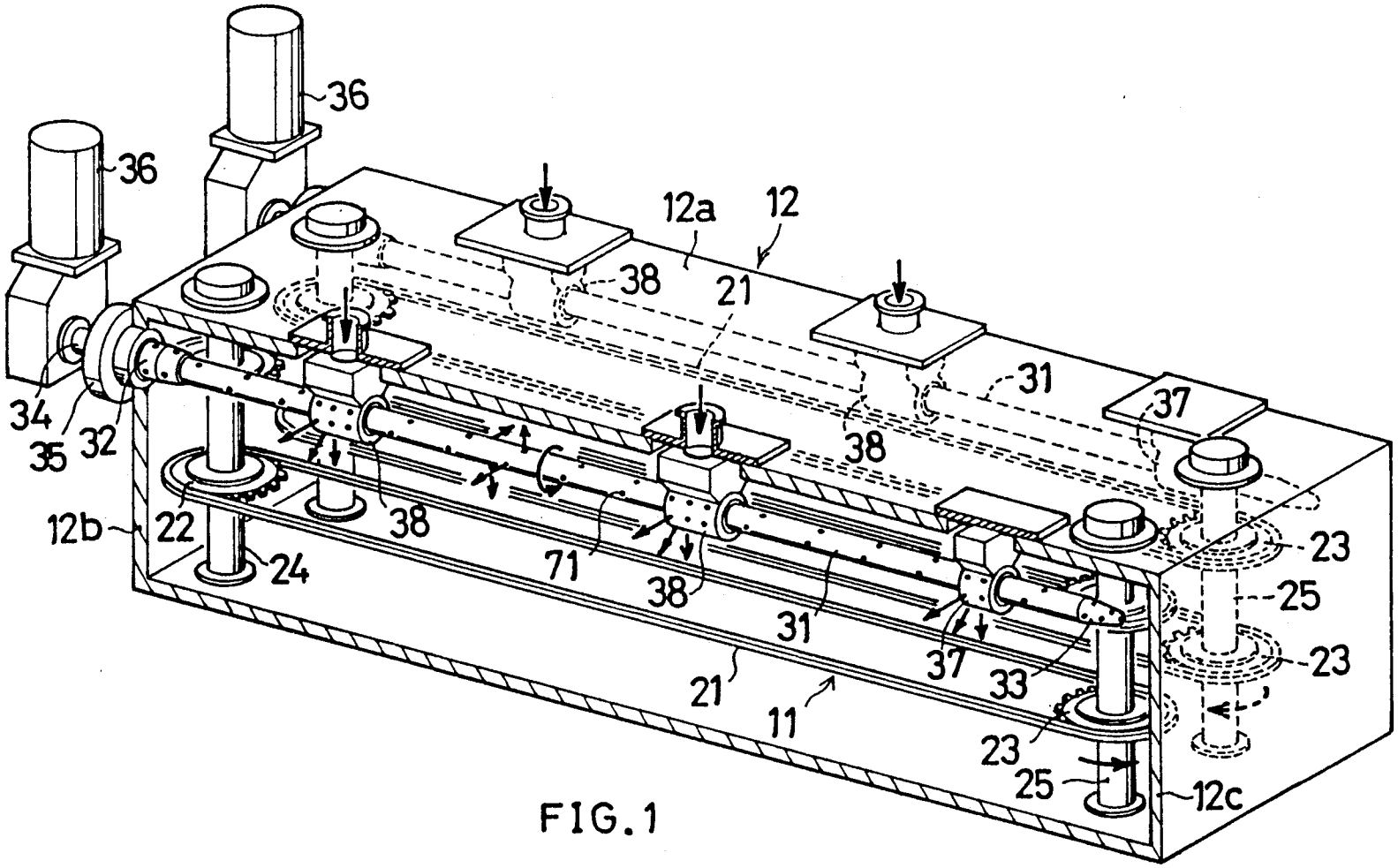
FIG. 1 is a perspective view partly broken away and showing an apparatus of the invention in its entirety.
Figure 2:
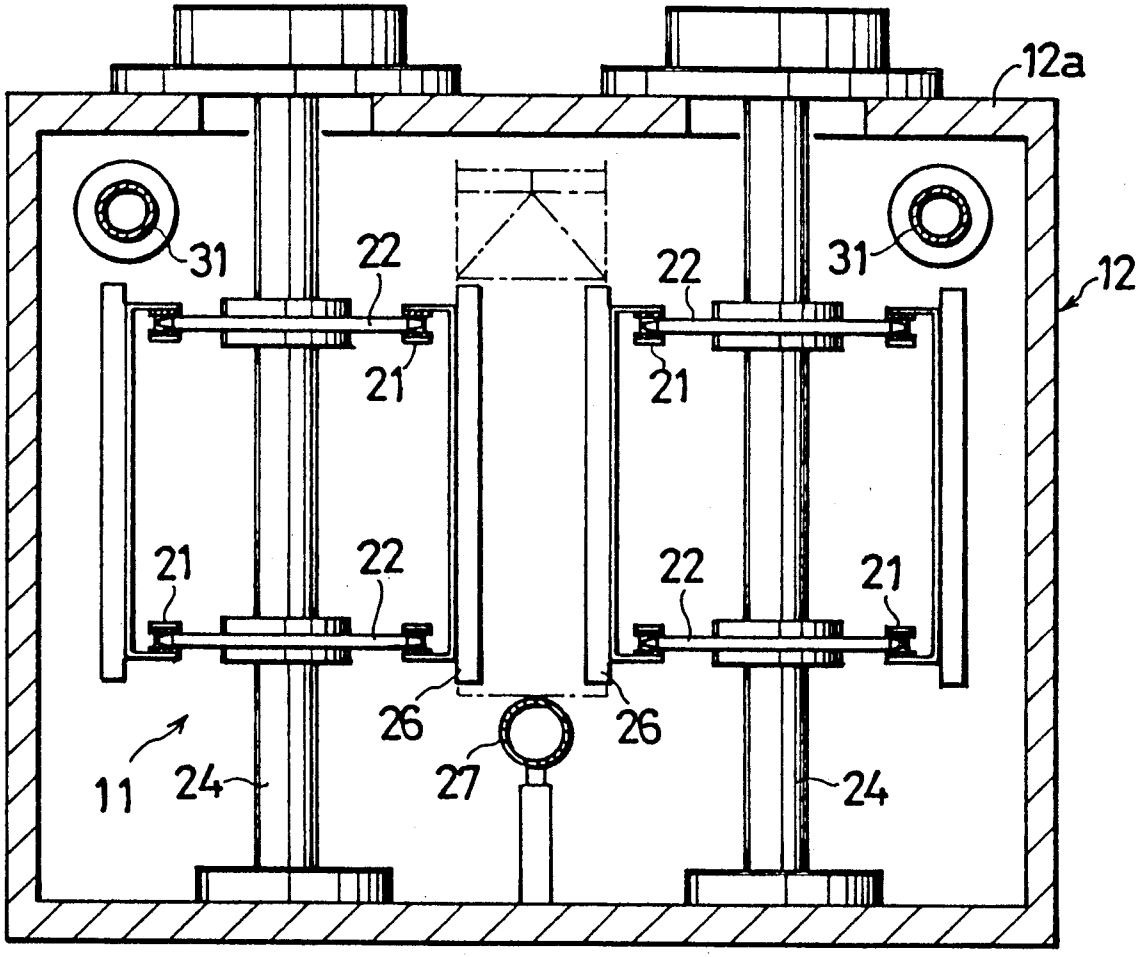
FIG. 2 is a view in cross section of the entire apparatus.

The container transport conveyor 11 is a chain conveyor having a path of transport extending from rear to front and comprises a pair of upper and lower endless chains 21 arranged at each of opposite sides of the path, two pairs of front drive sprockets 22 and rear driven sprockets 23 disposed at each side and having the respective upper and lower endless chains 21 reeved therearound, a pair of vertical drive shaft 24 and driven shaft 25 disposed at each side and carrying the drive sprockets 22 and the driven sprockets 23, respectively, and a multiplicity of vertical pieces 26 L-shaped in cross section, attached to the upper and lower chains 21 and arranged at a specified spacing. Two vertical pieces 26 on each side provide a holder. When the holder is brought to the transport path side, a container is held by the holder. Disposed under the path of travel of the holder in parallel thereto is a rail 27 for guiding containers by supporting the bottoms thereof (see FIG. 2).

A horizontal spray pipe 31 is disposed above the return side of the chains 21 on each side of the transport path and extends along the upper side corner of the chamber 12 inside thereof approximately over the entire length thereof. Front and rear end caps 32 and 33 are fitted over the respective ends of the spray pipe 31. The front end cap 32 is integral with a forwardly projecting support shaft 34 (see FIG. 3). On the other hand, the front wall 12*b* of the chamber 12 is provided with a front bearing 35. The support shaft 34 extends forward from and is supported by the front bearing 34. The projecting end of the shaft 34 is connected to the output shaft of a motor 36 having a reduction gear. The spray pipe 31 is further supported at a portion thereof close to its rear end by a rear bearing 37 and at two intermediate portions thereof between the front and rear ends by intermediate bearings 38.

Figure 11:
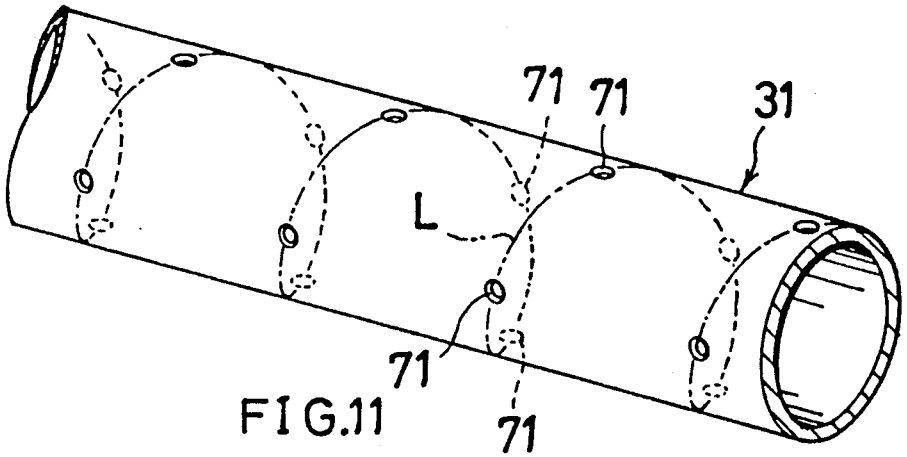
FIG. 11 is a diagram illustrating the arrangement of spray orifices in the spray pipe.

A multiplicity of spray orifices 71 are formed in the portions of the spray pipe 31 left exposed inside the chamber 12 and not fitted in the bearings 37, 38 and arranged approximately over the entire length of the pipe. With reference to FIG. 11, the multiplicity of spray orifices 71 are positioned on a line L extending helically on the spray pipe 31. More specifically, one spray orifice 71 is formed on each of circumferences equidistantly spaced along the length of the spray pipe 71, and every two adjacent spray orifices 71 have their axes displaced from each other by 90 degrees.

Figure 3:
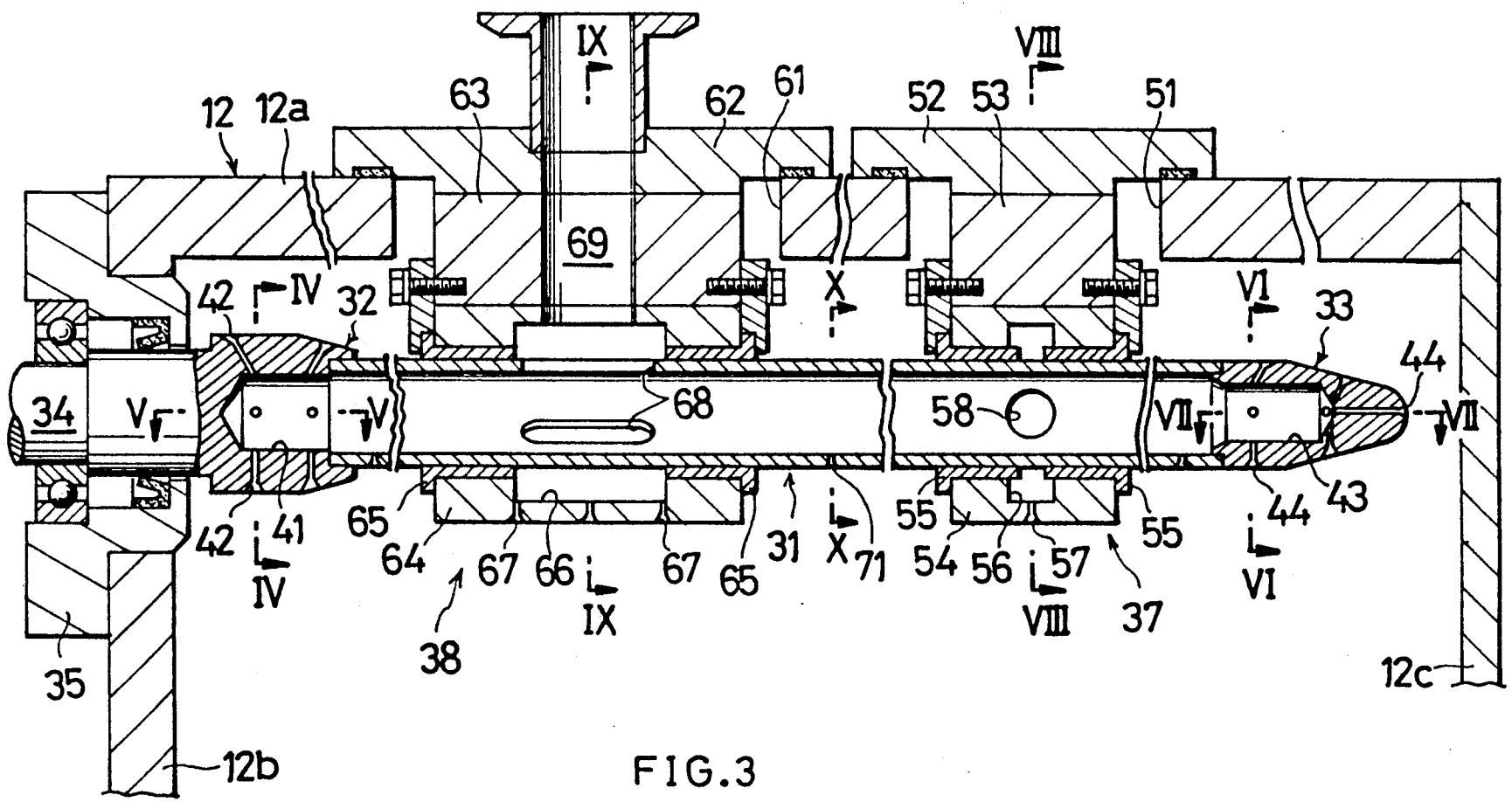
FIG. 3 is a view in vertical longitudinal section of a spray pipe and the neighborhood thereof.
Figure 4:
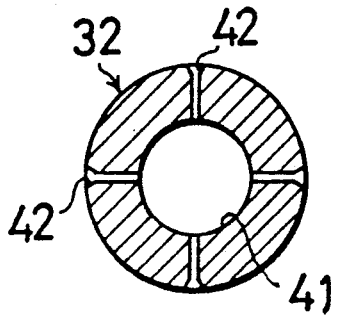
FIGS. 4 to 10 are views in section taken along the line IV—IV, line V—V, line VI—VI, line VII—VII, line VIII—VIII, line IX—IX and line X—X in FIG. 3, respectively.
Figure 5:
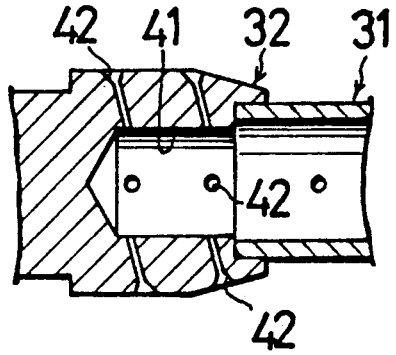
Figure 6:
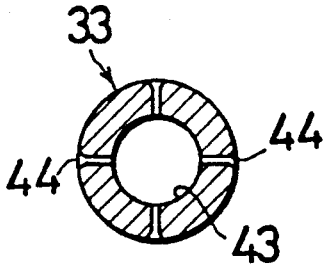
Figure 7:
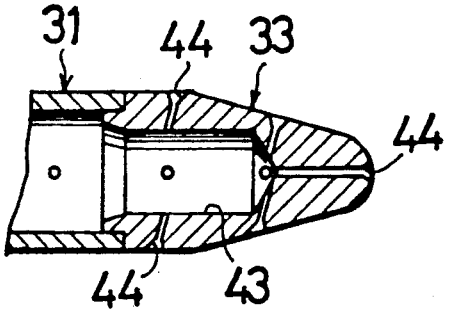
Figure 8:
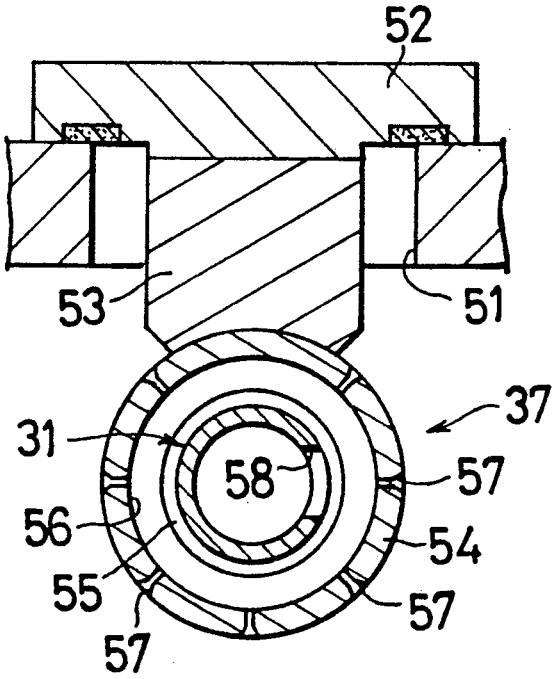
Figure 9:
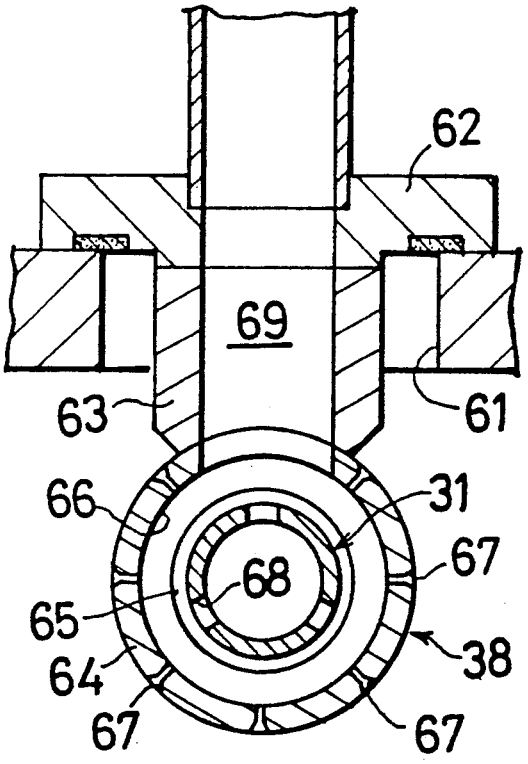
Figure 10:
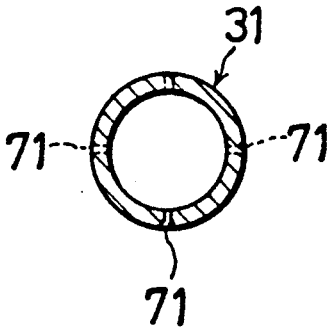
Figure 12B:
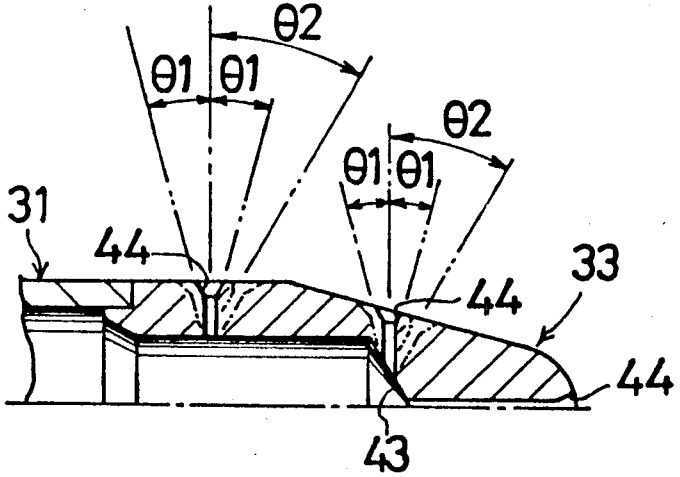
FIG. 12 shows the arrangements of spray orifices in end caps.
Figure 12A:
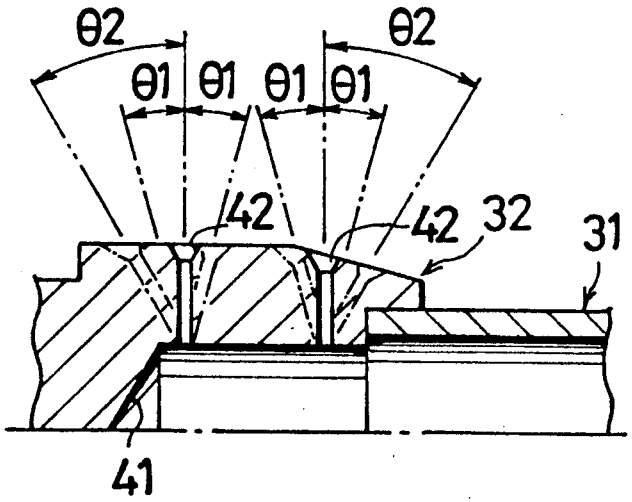

As shown in detail in FIG. 3, four spray orifices 42 are formed in the peripheral wall of the front end cap 32 defining a blind bore 41, on each of two circumferences spaced apart by a predetermined distance longitudinally of the spray pipe. With reference to FIG. 12 (a), of the four spray orifices 42 on the front circumference, the first spray orifice 42 is oriented vertically upward, the second and third spray orifices 42 are inclined at an agle of $\theta 1$ with the first orifice although oriented forward and rearward respectively, and the fourth spray orifice 42 is inclined forward at a larger angle of $\theta 2$ with the first orifice. Of the four spray orifices 42 on the rear circumference, the first spary orifice 42 is oriented vertically upward, and with respect to this orifice, the second and third orifices 42 are inclined by an angle $\theta 1$ although oriented forward and rearward respectively, and the fourth orifice 42 is inclined rearward by a larger angle of $\theta 2$.

Four spray orifices 44 are also formed in the peripheral wall of the rear end cap 33 defining a blind bore 43, on each of two circumferences spaced apart by a predetermined distance longitudinally of the pipe. With reference to FIG. 12 (*b*), of the four spray orifices 44 on the front circumference, the first spray orifice 44 is oriented vertically upward, and with respect to this orifice, the second and third orifices 44 are inclined by an angle $\theta 1$ although oriented forward and rearward respectively, and the fourth orifice 44 is inclined rearward by a larger angle of $\theta 2$. The four spray orifices 44 on the rear circumference are each same as the corresponding one of the four front spray orifices 44 in respect of orientation and angle. The angle $\theta 1$ is 15 degrees, and $\theta 2$ is 30 degrees. The rear end cap 33 further has a spray orifice 44 extending from the bottom of the blind bore 43 straightly rearward.

The rear bearing 37 comprises a horizontal short tubular housing 54 suspended by a suspending member 53 from a closure plate 52 covering a hole 51 in the top wall 12*a* of the chamber 12, and front and rear bushes 55 fitted in the housing 54 and spaced apart from each other. The housing 54 is formed in its inner surface with an annular groove 56 around the clearance between the two bushes 55. Except at the top portion of the housing 54, a plurality of spray orifices 57 extend outward from the bottom of the groove 56 and are arranged in a row as equidistantly spaced along the circumference of the housing. On the other hand, the spray pipe 31 has a circular communication hole 58 in communication with the clearance between the bushes 55.

Like the rear bearing 37, each intermediate bearing 38 comprises a horizontal short tubular housing 64 suspended by a suspending member 63 from a closure plate 62 covering a hole 61 in the top wall 12*a* of the chamber 12, and front and rear bushes 65 fitted in the housing 64 and spaced apart from each other. Similarly, the housing 64 is formed in its inner surface with an annular groove 66 and has a plurality of spray orifices 67 extending outward from the bottom of the groove 66 and arranged in three rows which are spaced apart longitudinally of the spray pipe. The spray pipe 31 has three communication holes 66 each in the form of an elongated circle, equidistantly spaced circumferentially of the pipe and communicating with the clearance between the two bushes 65. A port 69 for admitting a pressurized cleaning solution extends from the annular groove 66 through the suspending member 63 and the closure plate 62.

Now, suppose the spray pipe 31 is 1900 mm in entire length, 25.4 mm in outside diameter and 19.4 mm in inside diameter, and the spray orifices 71 are 16 mm in pitch and 1 mm in diameter. When a cleaning solution is supplied through each of the two supply ports at a rate of 0.6 to 0.8 kg/cm$^2$, 6000 to 8000 liters/hr while rotating the spray pipe, for example, at a speed of 100 r.p.m., the solution forced out from the spray orifices forms a circle of jet about 2 m in diameter to completely clean the interior of the chamber.

What is claimed is:

1. An apparatus for cleaning an interior of an aseptic chamber having enclosed therein a container transport conveyor of a packaging machine and separating off a required packaging work space from the outside air, the apparatus comprising:

at least one rotatable spray pipe means for receiving pressurized cleaning solution, and for rotatably spraying and cleaning the interior of the aseptic chamber, said rotatable spray pipe means being disposed inside the aseptic chamber and extending approximately over the entire length of the path of transport of containers in parallel thereto, the spray pipe means having a multiplicity of spray orifices and at least one communication hole arranged at a predetermined spacing approximately over the entire length thereof;

at least one bearing means for supporting said rotatable spray pipe means within said aseptic chamber, said bearing means having at least one bearing spray orifice which receives said cleaning solution through said communication hole of said rotatable spray pipe means to be sprayed therefrom; and means for supplying a pressurized cleaning solution to the interior of the spray pipe means.

2. An apparatus as defined in claim 1, wherein the spray orifices are positioned on a line extending helically on the spray pipe means.

3. An apparatus as defined in claim 1, wherein two end caps are fitted over the respective ends of the spray pipe means within said interior of said aseptic chamber and are each formed with a plurality of spray orifices, and at least one of the spray orifices of each end cap is oriented toward the outer end of the corresponding end cap.

4. An apparatus as defined in claim 1, wherein said communication hole is formed in the spray pipe means at a lengthwise intermediate portion thereof, and a horizontal short tubular bearing is fitted around the spray pipe means to cover the communication hole and formed in its inner peripheral surface with an annular groove communicating with the communication hole, the bearing having a plurality of spray orifices spaced apart circumferentially thereof and extending outward from the bottom of the annular groove.

5. An apparatus as defined in claim 4, wherein the bearing is suspended from the top wall of the aseptic chamber by a suspending member, and the suspending member is formed with a port communicating with the communication hole for admitting the pressurized cleaning solution into the spray pipe means.

6. An apparatus as defined in claim 1, wherein two end caps are fitted over the respective ends of the spray pipe means within said interior of said aseptic chamber, and the outer end of one of the two end caps is integral with a support shaft extending in alignment with the spray pipe means, the support shaft extending through and being rotatably supported by an end wall of the aseptic chamber.

7. An apparatus as defined in claim 1, wherein the aseptic chamber is square to rectangular in cross section, and the spray pipe means is disposed along the inside upper corner of the aseptic chamber at each of its opposite sides.

* * * * *